US005961229A

United States Patent [19]

Kameyama

[11] Patent Number: 5,961,229

[45] Date of Patent: Oct. 5, 1999

[54] RIBBON CASSETTE HAVING OPENABLE AND CLOSEABLE LID MEMBERS

[75] Inventor: Yoshikatsu Kameyama, Gifu-ken, Japan

[73] Assignee: Brother Kogyo Kabushiki Kaisha, Nagoya, Japan

[21] Appl. No.: 08/999,227

[22] Filed: Dec. 29, 1997

[30] Foreign Application Priority Data

Jan. 7, 1997 [JP] Japan ..... 9-000951

[51] Int. Cl.[6] ..... B41J 35/28

[52] U.S. Cl. ..... 400/208; 400/207

[58] Field of Search ..... 400/207, 208, 400/208.1, 224.2, 246

[56] References Cited

U.S. PATENT DOCUMENTS

| | | | |
|---|---|---|---|
| D. 383,743 | 9/1997 | Suwa et al. | D14/118 |
| 4,676,678 | 6/1987 | Watanabe | 400/208 |
| 4,978,240 | 12/1990 | Katsuno | 400/224.2 |
| 5,269,612 | 12/1993 | Shimoha et al. | 400/207 |
| 5,378,072 | 1/1995 | Gunderson | 400/236 |
| 5,399,035 | 3/1995 | Nakae | 400/207 |
| 5,741,080 | 4/1998 | Tomoda et al. | 400/246 |
| 5,769,547 | 6/1998 | Igarashi | 400/208 |

FOREIGN PATENT DOCUMENTS

| | | |
|---|---|---|
| A-5-318863 | 12/1993 | Japan . |
| A-6-246995 | 9/1994 | Japan . |
| 7-283919 | 10/1995 | Japan . |
| A-9-136464 | 5/1997 | Japan . |

OTHER PUBLICATIONS

Photographs of a ribbon cassette sold in Jul., 1995.

Brother's PC–101 Ribbon Cassette, commercially available: Jul., 1995.

*Primary Examiner*—Edgar Burr
*Assistant Examiner*—Leslie J. Grohusky
*Attorney, Agent, or Firm*—Oliff & Berridge, PLC

[57] ABSTRACT

A ribbon cassette includes a lid member that is not abruptly opened when a cassette is loaded into a printing apparatus and/or a facsimile apparatus using the ribbon cassette. Retained parts are provided on both side faces of a supplying part main body of a ribbon supplying part in a ribbon cassette and retaining parts which are detachably engaged with the retained parts to retain a lid member by the supplying part main body are provided on side faces of the lid member. While each of the retained parts is a protrusion projecting sideward, each of the retaining parts on the side faces of the lid member via a hinge part and has an engagement hole with which the protrusion is detachably engaged. The ribbon supplying part has engaged parts provided near the retained parts and engagement projecting parts which are provided near the retaining parts and detachably engaged with the retained parts, thereby constructing the engagement relation countering the force acting in the direction of cancelling the retaining relation between the retained parts and the retaining parts.

11 Claims, 13 Drawing Sheets

RIBBON CASSETTE HAVING OPENABLE AND CLOSEABLE LID MEMBERS

BACKGROUND OF THE INVENTION

1. Field of the Invention

The present invention relates to a ribbon cassette, and a printing apparatus and a facsimile apparatus each using the same.

2. Description of Related Art

Hitherto, it is known that in a printing apparatus used for a facsimile apparatus or the like, a ribbon cassette in which an ink ribbon is housed in a cassette case is used in order to make replacement of the ink ribbon for printing easy (refer to, for example, JP-A-7-283919).

The ribbon cassette has a cylindrical ribbon supplying part for supplying an ink ribbon, a cylindrical ribbon take-up part for taking up the ink ribbon, and a connecting arm for connecting both of the parts. Printing is performed by a print head in a position while the ink ribbon is moved from the ribbon supplying part to the ribbon take-up part.

As shown in FIGS. 11 and 12, a casing 100A of such a ribbon cassette 100 is constructed by: main body parts 101A, 102A in which a ribbon supplying part 101 and a ribbon take-up part 102 are connected to connecting arms 103, 103; and lid members 101B, 102B which are connected to the main body parts 101A, 102A openably and closably. In the ribbon supplying part 101, a supply roll 117 around which an ink ribbon 116 is wound is housed. In the ribbon take-up part 102, a take-up roll 118 for taking up the ink ribbon 116 supplied from the supply roll 117 is housed.

Further, in order to prevent the lid members 101B, 102B from being opened arbitrarily at the time of operation, the lid members 101B, 102B are provided with engaged parts 104, 104, 104, 104 and the main body parts 101A, 102A are provided with engagement parts 105, 105, 105, 105 which are detachably engaged with the engaged parts 104.

As shown in FIG. 11, the ink ribbon 116 is arranged so as to pass the inner sides of the engagement parts 105. The length h1 in the axial direction of the ribbon cassette 100 is longer than the width h2 of the ink ribbon 116.

The ribbon cassette 100 is loaded into a facsimile apparatus as follows. First, as shown in FIG. 13A, a lid member 111 is opened, two levers 113 on a main body casing 112 side are lifted to stand a print head 114. Then, as shown in FIG. 13B, the ink ribbon is tightened by rotating a ribbon roll (not shown) or the like so that the ink ribbon is in a tensed state. As shown in FIG. 13C, the ribbon cassette 100 is held and inserted by using an arrow 115 as a guide, and as shown in FIG. 13D, the ribbon cassette 100 is loaded into a predetermined position in the main body casing 112. Subsequently, as shown in FIG. 13E, a procedure for laying the print head 114 and closing the lid member 111 is performed.

According to the above-mentioned structure, however, since the engaged parts 104 and the engagement parts 105 are provided along the axial direction, the length h1 in the axial direction of the ribbon cassette 101 is long. This structure does not serve to reduce the size which has been demanded in recent years.

In such a ribbon cassette, as mentioned above, the ribbon supplying part 101 and the ribbon take-up part 102 are connected by the elongated connecting arms 103 and have a shape which tends to be twisted and deformed. When the ribbon cassette 100 is loaded into the main body casing 112, there is, consequently, the possibility that a torsion force acts on the ribbon cassette 100. Depending on the way the ribbon cassette 100 is held, the ribbon cassette 100 is twisted and deformed, the engagement between the engaged parts 104 and the engagement parts 105 is not possible, the lid member 111 is opened, and the ink ribbon 116 is exposed. It is, therefore, necessary to reliably prevent such opening of the lid member 111.

SUMMARY OF THE INVENTION

In consideration of the above points, it is an object of the invention to provide a compact ribbon cassette, and a printing apparatus and a facsimile apparatus each using the ribbon cassette.

In order to achieve the object, a first aspect of the present invention provides a ribbon cassette having a ribbon supplying part for supplying an ink ribbon, a ribbon take-up part for taking up the ink ribbon, and a connecting part for connecting both of the parts. The ribbon supplying part has a supplying part main body connected to the connecting part and a lid member openably and closably connected to the supplying part main body. A retained part is provided on an end face of one of the supplying part main body and the lid member, and a retaining part is provided on an end face of the other of the supplying part main body and the lid member. The retaining part is detachably engaged with the retained part to retain the lid member by the supplying part main body.

Consequently, when the retained part provided on the end face of one of the supplying part main body of the ribbon supplying part and the lid member is detachably retained by the retaining part provided on the end face of the other one, the lid member is retained by the supplying part main body. Since the retained part and the retaining part are provided on the end faces of the supplying part main body of the ribbon supplying part and the lid member, the length in the axial direction of the ribbon supplying part can be almost equalized to the width of the ink ribbon irrespective of the shape of the retained part and the retaining part. It is therefore advantageous to realize the reduction in size.

In embodiments, the retained part can be a protrusion projecting sideward, and the retaining part can be provided on the end face of the other one of the supplying part main body and the lid member via a hinge part and may include an engagement hole with which the protrusion is detachably engaged.

Consequently, by detachably engaging the protrusion as the retained part with the engagement hole of the retaining part, the lid member can be securely retained by the supplying part main body.

An engaged part may be provided near one of the retained part and the retaining part, and an engagement projecting part may be provided near the other one of the retained part and the retaining part and detachably engaged with the engaged part, thereby constructing the engagement relation countering a force acting in the direction of cancelling the retaining relation between the retained part and the retaining part.

Since it is constructed to oppose the force acting in the direction of cancelling the retaining relation between the retained part and the retaining part by the engagement relation between the engaged part and the engagement part, in the ribbon supplying part, the retaining relation between the retained part and the retaining part is not easily cancelled by an unnatural force such as torsion force acting when the ribbon cassette is loaded or the like.

A second aspect of the present invention relates to a ribbon cassette comprising a ribbon supplying part for supplying an ink ribbon, a ribbon take-up part for taking up the ink ribbon, and a connecting part for connecting both of the above parts, wherein the ribbon take-up part has a take-up part main body connected to the connecting part and a lid member openably and closably connected to the take-up part main body, a retained part is provided on an end face of one of the take-up part main body and the lid member, and a retaining part which is detachably engaged with the retained part to retain the lid member by the supplying part body is provided on an end face of the other one of the take-up part main body and the lid member.

Consequently, when the retained part provided on the end face of one of the take-up part main body of the ribbon take-up part and the lid member is detachably retained by the retaining part provided on the end face of the other one of the take-up part main body of the ribbon take-up part and the lid member, the lid member is retained by the take-up part main body. Since the retained part and the retaining part are provided on the end faces of the take-up part main body of the ribbon take-up part and the lid member, the length in the axial direction of the ribbon take-up part can be almost equalized to the width of the ink ribbon irrespective of the shape of the retained and retaining parts. It is therefore advantageous to reduce the size.

In embodiments, the retained part may be a protrusion projecting sideward, and the retaining part may be provided on the end face of the other one of the take-up part main body and the lid member via the hinge member and may include an engagement hole with which the protrusion is detachably engaged.

Consequently, by detachably engaging the protrusion serving as the retained part with the engagement hole of the retaining part, the lid member can be securely retained by the take-up part main body.

An engaged part may be provided near one of the retained part and the retaining part, and an engagement projecting part may be provided near the other one of the retained part and the retaining part and detachably engaged with the engaged part, thereby constructing the engagement relation countering a force acting in the direction of cancelling the retaining relation between the retained part and the retaining part.

Since it is constructed to oppose the force acting in the direction of cancelling the retaining relation between the retained part and the retaining part by the engagement relation between the engaged part and the engagement part, in the ribbon take-up part, the retaining relation between the retained part and the retaining part is not easily cancelled by a torsion force or the like acting when the ribbon cassette is loaded or the like.

In embodiments, not only the ribbon take-up part, but also the ribbon supplying part may have a supplying part main body connected to the connecting part and the lid member, the retained part may be provided on the end face of one of the supplying part main body and the lid member, and the retaining part which is detachably engaged with the retained part to retain the lid member by the supplying part main body may be provided on the end face of the other one.

Therefore, not only in the ribbon take-up part but also in the ribbon supplying part, when the retained part is detachably retained by the retaining part, the lid member is retained by the supplying part main body. Consequently, the length in the axial direction of the ribbon supplying part can be almost equalized to the width of the ink ribbon irrespective of the shape of the retained part and the retaining part, so that it is advantageous to reduce the size.

In embodiments, while the retained part may be a protrusion projecting sideward, the retaining part may be provided on the end face of the other one of the supplying part main body and the lid member via the hinge member and may include an engagement hole with which the protrusion is detachably engaged.

By detachably engaging the protrusion serving as the retained part with the engagement hole of the retaining part, not only in the ribbon take-up part but also in the ink supplying part, the lid member can be securely retained by the supplying part main body.

An engaged part may be provided near one of the retained part and the retaining part, and an engagement projecting part may be provided near the other one of the retained part and the retaining part and detachably engaged with the engaged part, thereby constructing the engagement relation countering a force acting in the direction of cancelling the retaining relation between the retained part and the retaining part.

Since it is constructed to oppose the force acting in the direction of cancelling the retaining relation between the retained part and the retaining part by the engagement relation between the engaged part and the engagement part, in the ribbon supplying part, in a manner similar to the ribbon take-up part, the retaining relation between the retained part and the retaining part is not easily cancelled by a torsion force acting when the ribbon cassette is loaded or the like.

A third aspect of the invention relates to a printing apparatus comprising a main body casing which has an opening in which a recording head is provided and a lid member for openably and closably closing the opening of the main body casing, wherein the ribbon cassette according to the first and second aspects of the invention is detachably attached from the opening in correspondence to the recording head.

Therefore, by reducing the size of the ribbon cassette, reduction in size of the printing apparatus can be accordingly realized.

A fourth aspect of the invention relates to a facsimile apparatus comprising a reception buffer that stores received reception image information and recording structure including a recording head including a plurality of heater elements arranged in a line that records the reception image information every predetermined lines onto a recording medium via an ink ribbon having the width which is substantially equal to a width of a recording area, wherein the printing apparatus according to the third aspect of the invention is used as the recording structure.

Consequently, by reducing the size of the ribbon cassette, the size of the facsimile apparatus can be accordingly reduced.

The invention is embodied in the modes as mentioned above and has effects as described below.

According to the first aspect, since the retained part provided on the end face of one of the supplying part main body and the lid member is detachably engaged with the retaining part provided on the end face of the other one, thereby retaining the lid member by the supplying part main body, the length in the axial direction of the ribbon supplying part can be almost equalized to the width of the ink ribbon irrespective of the shape of the retained part and the retaining part. It is therefore advantageous to realize the reduction in size.

By detachably engaging the protrusion serving as the retained part with the engagement hole of the retaining part, the lid member is retained by the supplying part main body. Therefore, the lid member can be securely retained by the supplying part main body with a simple structure.

Since the force acting in the direction of cancelling the retaining relation between the retained part and the retaining part is opposed by the engagement relation between the engaged part and the engagement projecting part, the retaining relation between the retained part and the retaining part is not easily cancelled by an unnatural force such as torsion force acting when the ribbon cassette is loaded or the like. Consequently, the lid member is prevented from being abruptly opened.

Since the retained part provided on the end face of one of the take-up part main body and the lid member is detachably retained by the retaining part provided on the end face of one of the parts, thereby retaining the lid member by the take-up part main body, the length in the axial direction of the ribbon take-up part can be almost equalized to the width of the ink ribbon irrespective of the shape of the retained and retaining parts, so that it is advantageous to reduce the size.

By detachably engaging the engagement hole of the retaining part with the protrusion serving as the retained part so as to retain the lid member by the take-up part main body, the lid member can be securely retained by the take-up part main body with a simple structure.

Since the force acting in the direction of cancelling the retaining relation between the retained part and the retaining part is opposed by the engagement relation between the engaged part and the engagement part, the retaining relation between the retained part and the retaining part is not easily cancelled by an unnatural force such as torsion force acting when the ribbon cassette is loaded, and the lid member is prevented from being abruptly opened.

In the ribbon take-up part, as well as the ribbon supplying part, the retained parts are-provided on end faces of one of the supplying part main body and the lid member, and the retaining parts which are detachably engaged with the retained parts to retain the lid member by the supplying part main body are provided on end faces of the other one. Consequently, not only in the ribbon take-up part but also in the ribbon supplying part, the length in the axial direction can be almost equalized to the width of the ink ribbon irrespective of the shape of the retained parts and the retaining parts, so that it is advantageous to reduce the size as a whole.

By detachably engaging the protrusion as the retained part with the engagement hole of the retaining part, not only in the ribbon take-up part but also in the ink supplying part, the lid member can be securely retained by the supplying part main body.

Also, in the ribbon supplying part, in a manner similar to the ribbon take-up part, the force acting in the direction of cancelling the retaining relation between the retained part and the retaining part is opposed by the engagement relation between the engaged part and the engagement projecting part, and the retaining relation between the retained part and the retaining part is not easily cancelled by an unnatural force such as torsion force acting when the ribbon cassette is loaded or the like.

According to the second aspect of the present invention, the ribbon cassette according to the first aspect is detachably attached in the main body casing of the printing apparatus in correspondence to the recording head. The size of the whole apparatus can be consequently reduced.

According to the third aspect, a facsimile apparatus in which the printing apparatus according to the second aspect is used as the recording structure. Consequently, the size of the whole apparatus can be reduced.

BRIEF DESCRIPTION OF THE DRAWINGS

Preferred embodiments of the present invention will be described in detail with reference to the following figures, wherein.

DETAILED DESCRIPTION OF PREFERRED EMBODIMENTS

An embodiment of the invention will be described hereinbelow with reference to drawings.

Figure 1:
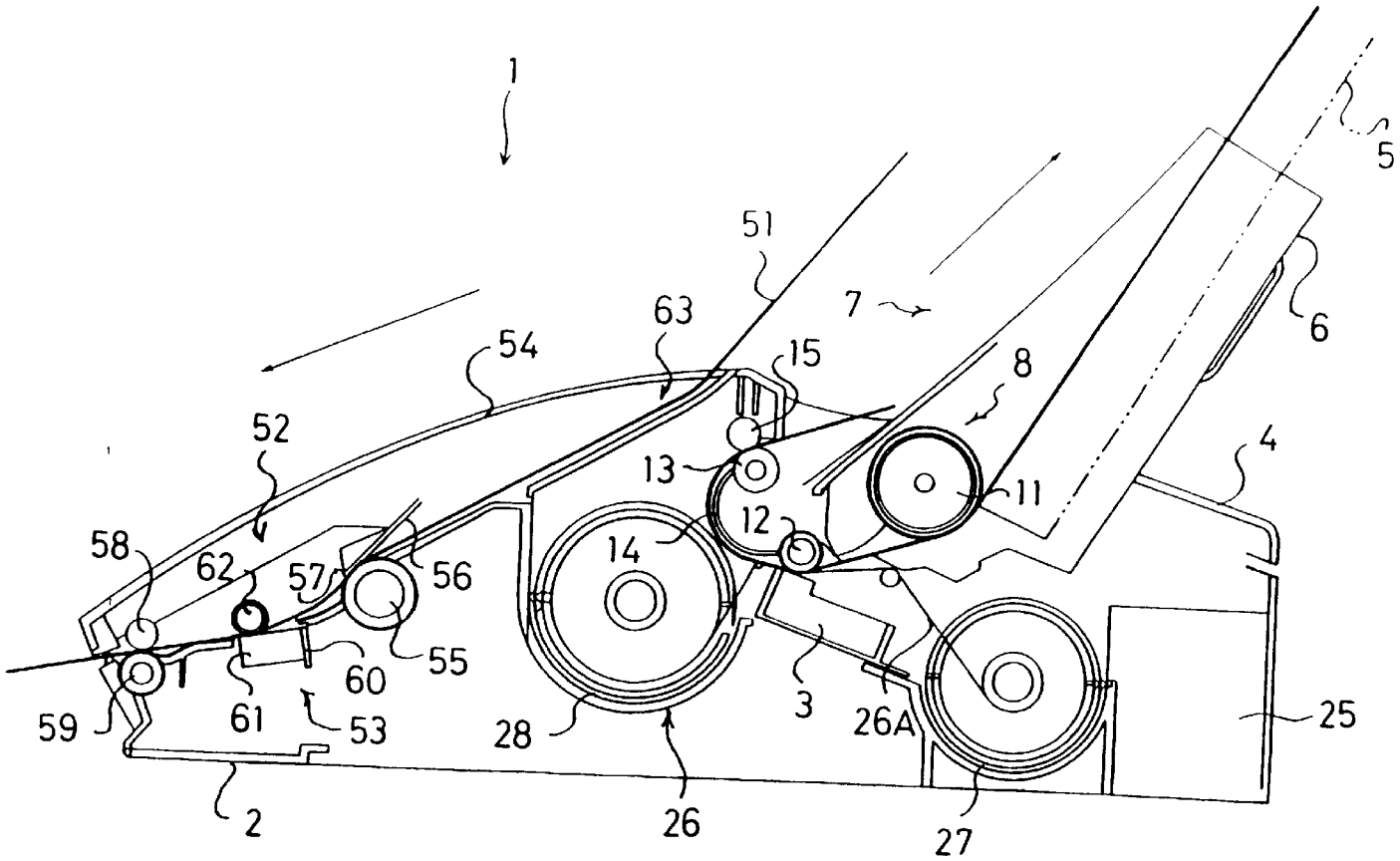
FIG. 1 is a central longitudinal section showing the internal structure of a facsimile apparatus according to the invention.

FIG. 1 shows the internal structure of a facsimile apparatus according to the invention. A facsimile apparatus 1 has a main body casing 2 having an opening 2A (refer to FIG. 3) in which a print head 3 is arranged in the opening 2A and a lid member 4 for closing the opening 2A of the main body casing 2 openably and closably.

In the lid member 4, a recording medium housing part 6 for housing a number of recording papers 5 in a stacked state and a recording medium conveying unit 8 for taking out the recording paper 5 from the recording medium housing part 6 and conveying it via the print head 3 to an ejecting part 7 as a space part above the lid member 4, for ejecting the printed recording paper 5 are integrally formed.

The recording medium conveying unit 8 of the lid member 4 has a paper feeding roller 11 for feeding the recording paper 5 from the recording medium housing part 6 one by one, a platen roller 12 provided opposite to the print head 3 on the main body casing 2 side, and an ejection roller 13 for ejecting the recording paper 5 to the ejection part 7 above the lid member 4. These rollers 11, 12, and 13 are sequentially arranged from the upstream side of the conveying direction. For smooth conveyance of the recording papers 5, the recording medium conveying unit 8 has also a U-shaped paper guide 14 arranged between the platen roller 12 and the ejection roller 13 and a pinch roller 15 provided in correspondence to the ejection roller 13. Although not specifically shown, the rollers 11, 12, and 13 are rotated by a motor for line feed (LF) via a gear mechanism.

The recording papers 5 stacked in the recording medium housing part 6 are fed from the recording medium housing part 6 to the platen roller 12 side one by one by the paper feeding roller 11 and an image such as characters, figures, and the like is recorded by the print head 3 via an ink ribbon 26A which will be described later in the position of the platen roller 12. The printed recording paper 5 is guided by the paper guide 14, passed through the pinch roller 15 and the ejection roller 13, and ejected to the ejection part 7 located above the recording medium housing part 6.

The tip of the recording paper 5 fed from the recording medium housing part 6 is detected by a sensor for detecting the recording paper tip (not shown) provided in correspondence to a paper conveyance path in the main body casing 2 and a printing timing by the print head 3 is determined on the basis of the detection signal. The ejection part 7 also has a recording paper ejection sensor (not shown) for detecting the ejection of the recording paper 5. When a plurality of sheets of paper are continuously recorded (printed) and the recording paper ejection sensor detects that the recording paper 5 on which the image is recorded is completely ejected, the next recording paper 5 is fed from the recording medium housing part 6 by the paper feeding roller 11. With such control, paper jam is avoided.

Figure 2:
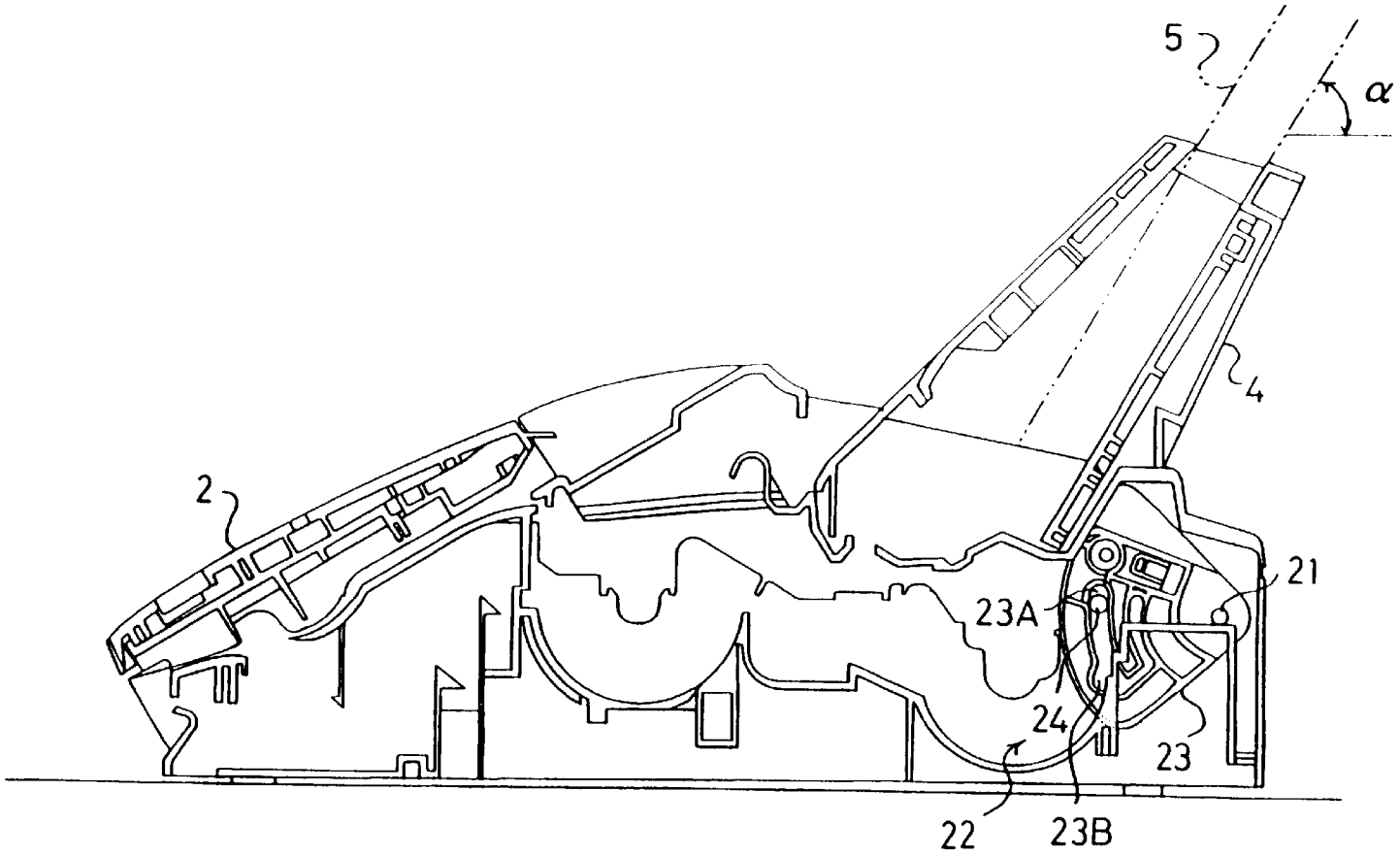
FIG. 2 is a central longitudinal section showing the relation between a main body casing and a lid member of the facsimile apparatus.
Figure 3:
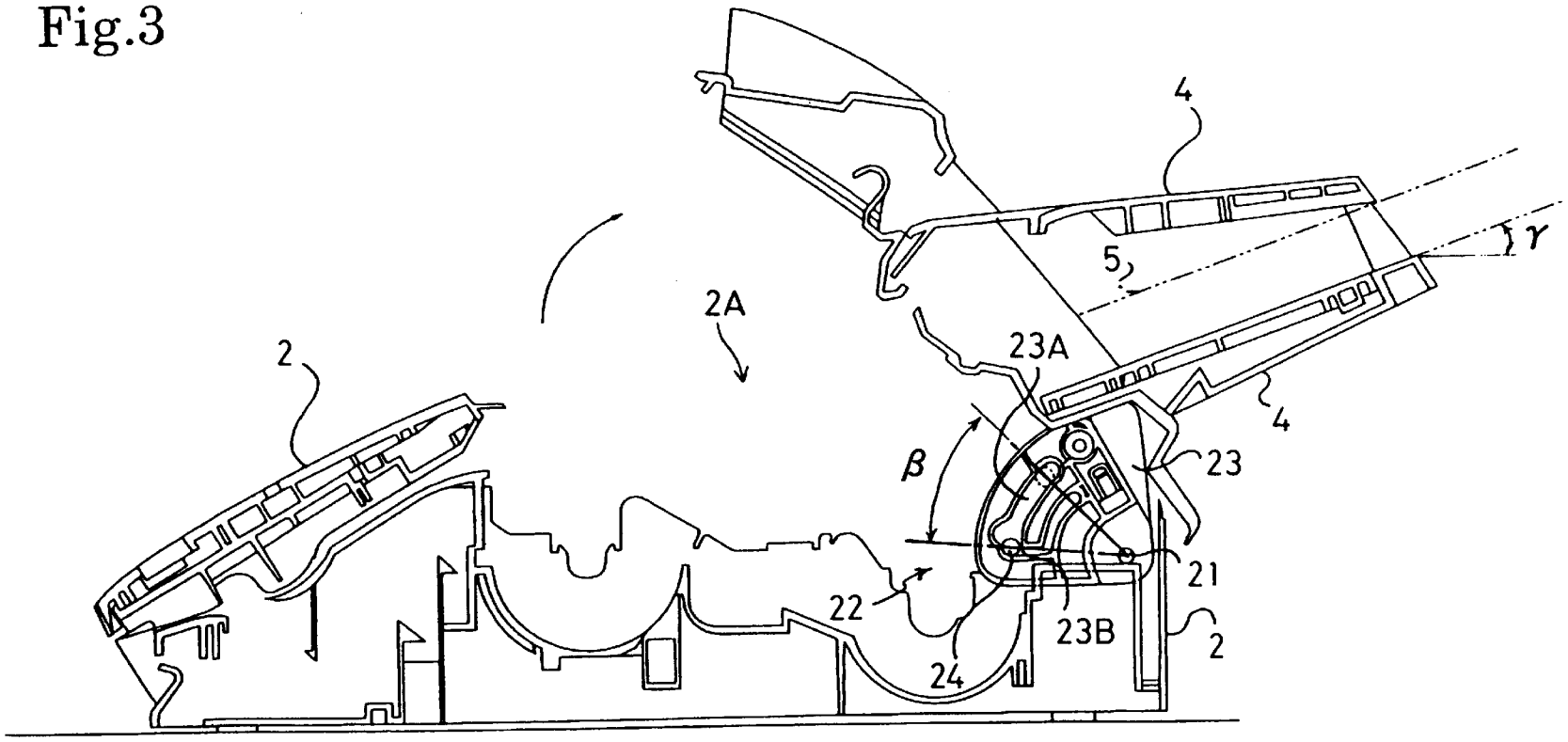
FIG. 3 is a central longitudinal section showing a state where the lid member of the facsimile apparatus is opened.
Figure 4:
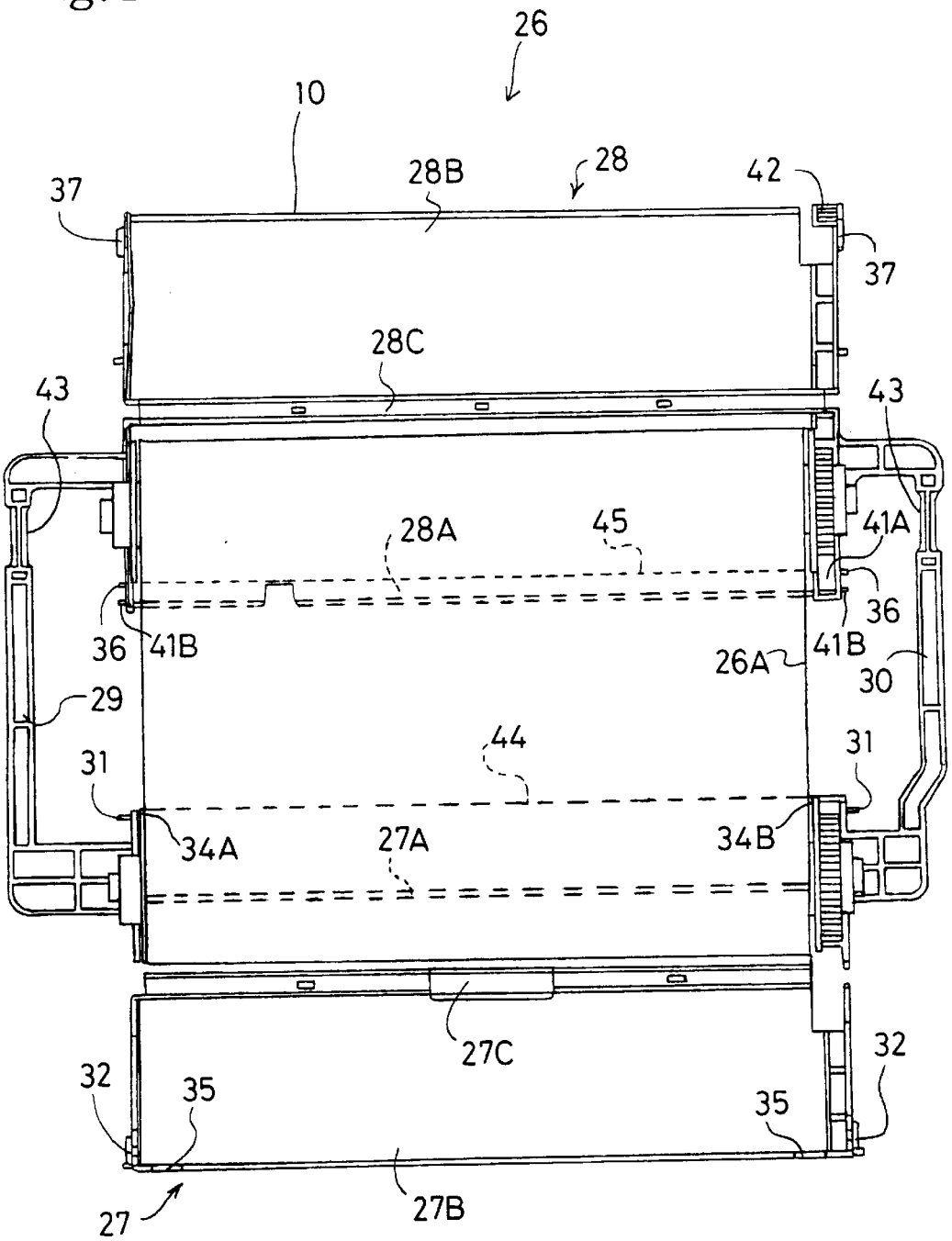
FIG. 4 is a plan view of a state where a ribbon supplying part and a ribbon take-up part of a ribbon cassette are opened.
Figure 5:
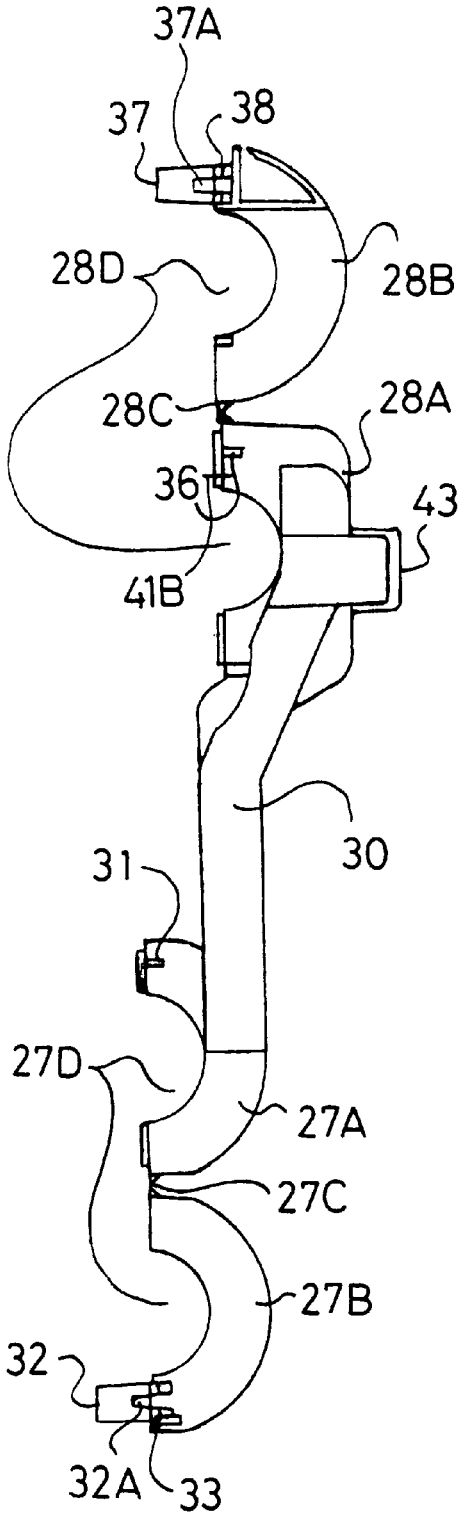
FIG. 5 is a right side elevational view of the ribbon cassette.
Figure 6:
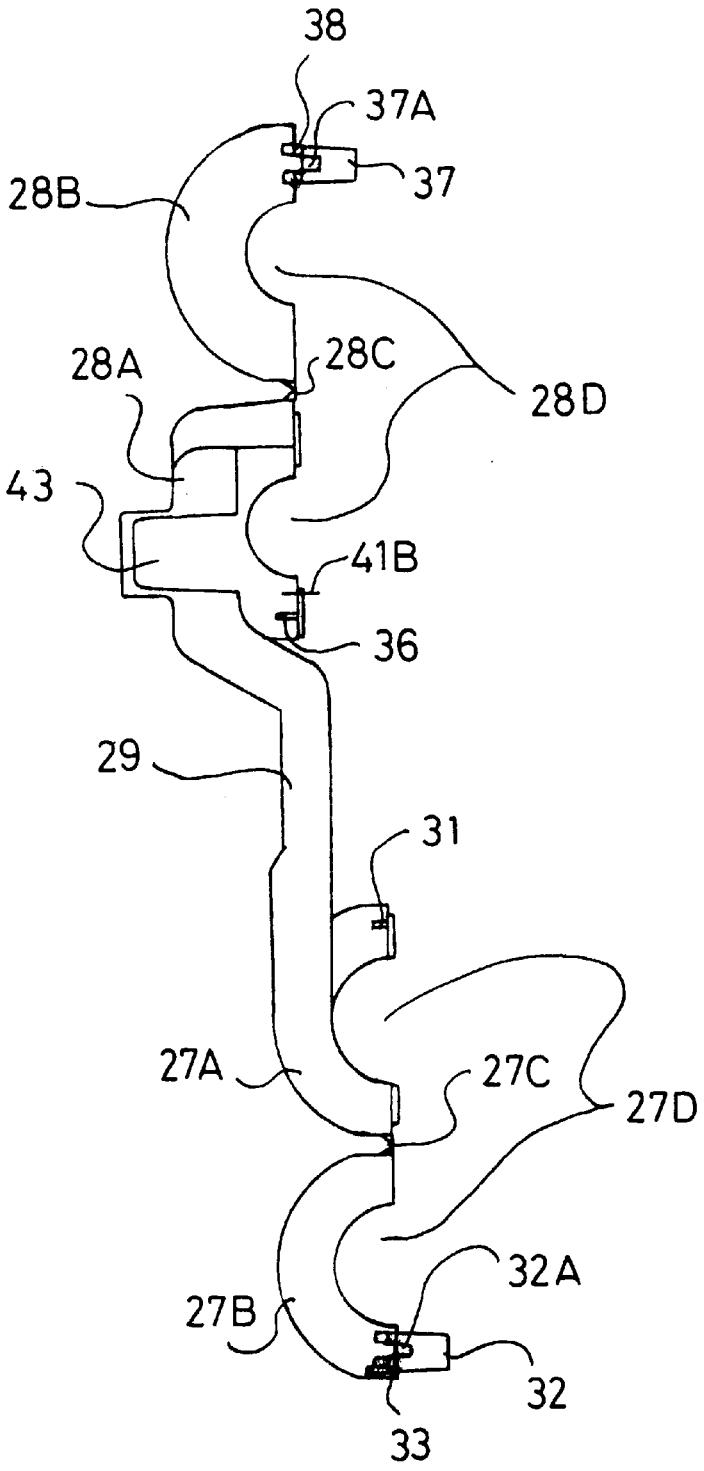
FIG. 6 is a left side elevational view of the ribbon cassette.
Figure 7:
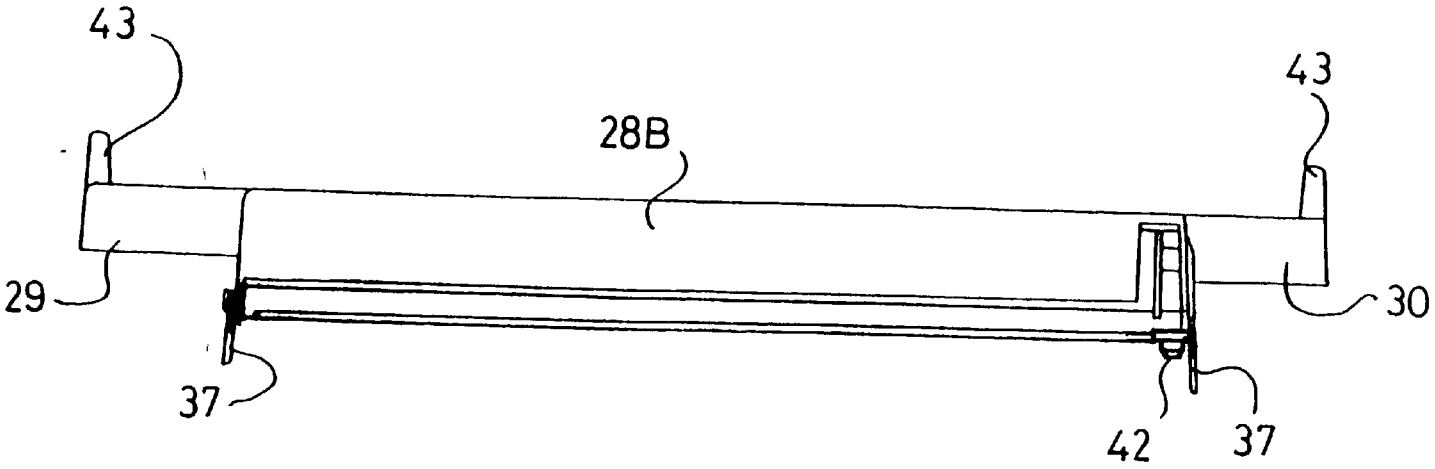
FIG. 7 is a plan view of the ribbon cassette.
Figure 8:
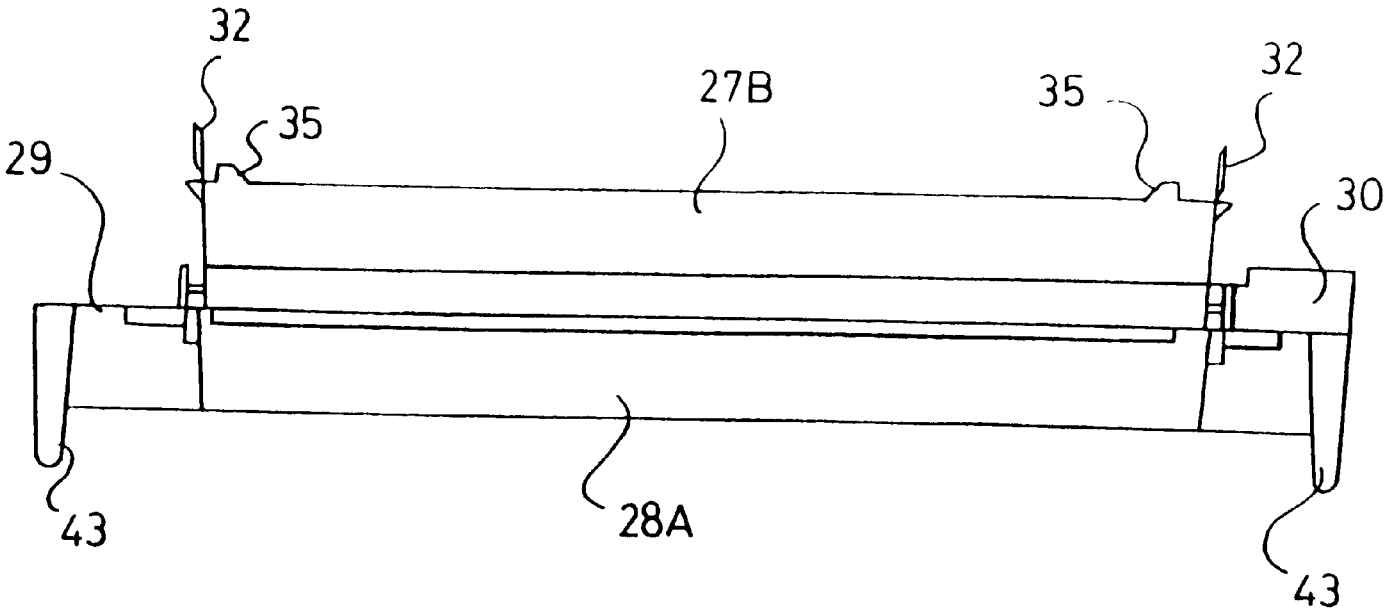
FIG. 8 is a bottom view of the ribbon cassette.

As shown in FIGS. 2 and 3, the lid member 4 is rotatably supported by the main body casing 2 around a rotation axis 21 as a rotation center. Further, the rotation angle of the lid member 4 with respect to the main body casing 2 is regulated by regulating means 22 in a range such that the recording paper 5 is not dropped from the recording medium housing part 4. The lid member 4 has a hinge member 23 and the hinge member 23 is rotatably supported by the main body casing 2 around the rotation axis 21.

Specifically, the regulating means 22 for regulating the rotational angle of the lid member 4 in a predetermined angle range has a guide hole 23A which is a circular arc shaped long hole opened in the hinge member 23 of the lid member 4 and an engagement pin member 24 which is movably engaged with the guide hole 23A opened on the main body casing 2 side.

In a state where the lid member 4 is closed, as shown in FIG. 2, the recording paper 5 and the horizontal plane has an angle $\alpha$ of about 60° so that the recording paper 5 is smoothly supplied. When the lid member 4 is opened, as shown in FIG. 3, the lid member 4 is turned by an angle $\beta$ of about 40° around the rotation axis 21 while the opening operation of the lid member 4 is guided by the engagement relation between the guide hole 23A of the hinge member 23 and the engagement pin member 24 which form the regulating means 22. Although the recording paper 5 and the horizontal plane has accordingly an angle $\gamma$ of about 20°, the further rotation of the lid member 4 is regulated and the lid member 4 is not opened more than that.

That is, the rotation angle of the lid member 4 with respect to the main body casing 2 for the horizontal plane is regulated within a range from 0° to about 40° by the regulating means 22 constructed by the guide hole 23A of the hinge member 23 and the engagement pin member 24. As a result of the regulation, the range of angle change of the recording medium housing part 6 for housing the recording paper 5 with respect to the horizontal plane is set in a range from about 60° to about 20°. Even in a state where the recording medium housing part 6 is closest to the horizontal state, the angle between the recording paper 5 and the horizontal plane is about 20°, so that the recording paper 5 is not dropped from the recording member housing part 6. The guide hole 23A has an engagement hole 23B. By engaging the engagement pin member 24 with the engagement hole 23B, the turn angle of the lid member 4 for the main body casing 2 with respect to the horizontal plane is maintained to the angle of about 40° (the maximum angle at which the recording paper 5 is not dropped from the recording medium housing part 6). Consequently, various works to the inside of the main body casing 2 can be performed while holding the lid member 4 in the most-widely opened state. It can be prevented that the lid member 4 is abruptly closed when such works are performed and the works are disturbed to be performed smoothly.

In addition to the print head 3, the main body casing 2 also comprises control means 25 which has a reception buffer (not shown) for temporarily storing reception image information received via a communication line and controls the printing by the print head 3 on the basis of the reception image information, and a ribbon cassette 26 which houses the ink ribbon 26A having the width almost the same as the recording area width of the print head 3 for printing by the print head 3 and is set in a predetermined position in the opening 2A. Although not specifically shown, the control means 25 is constructed by a microcomputer including a CPU, a ROM, and a RAM, and the RAM has the above-mentioned reception buffer.

The print head 3 is constructed by a thermal head having a number of heater elements arranged in a line in the direction perpendicularly crossing the feeding direction of the recording paper 5. The number of heater elements are selectively heated based on signals (reception image information) supplied to the control means 25. The printing is performed onto the recording paper 5 via the ink ribbon 26A in the ribbon cassette 26 and an image of characters, figures, and the like is recorded.

Although not specifically shown, the main body casing 2 also has an operation panel having a liquid crystal display, a keyboard, and the like for executing various operations.

In the ribbon cassette 26, the ink ribbon 26A is housed in a casing 10 integrally made of polypropylene. The details are as shown in FIGS. 4 to 8. The ribbon cassette 26 has a ribbon supplying part 27 for supplying the ink ribbon 26A, a ribbon take-up part 28 for taking up the ink ribbon 26A led from the ribbon supplying part 27 and passed between the print head 3 and the platen roller 12, and connecting parts 29 and 30 for connecting the parts 27 and 28.

The ribbon supplying part 27 has a supply part main body 27A connected to the connecting parts 29, 30 and a lid member 27B openably and closably connected to the supplying part main body 27A along a mating plane via a hinge part 27C (what is called a polypropylene (P.P.) hinge). While retained parts 31, 31 are provided on both of the right and left end faces of the supply part main body 27A, retaining parts 32, 32, which are detachably engaged with the retained parts 31 and retain the lid member 27B by the supply part main body 27A, are provided on both of the right and left end faces of the lid member 27B.

While the retained parts 31 are protrusions projecting sideward, the retaining parts 32 are provided via hinges 33, 33 (so-called P.P. hinges) on the other side faces of the lid member 27B and have engagement holes 32*a*, 32*a* with which the protrusions (retained parts 31) are detachably engaged.

The ribbon supplying part 27 has: engaged parts 34A, 34B provided near the retained parts 31; and engagement projecting parts 35, 35 that are provided near the retaining parts 32, detachably engaged with the engaged parts 34A, 34B, and construct the engagement relation countering the force acting in the direction of releasing the retaining relation between the retained parts 31 and the retaining parts 32. With respect to the engaged parts 34A, 34B, although the engaged part 34A is formed on the inner wall face of the supply part main body 27A and the other engaged part 34B is formed on the inner wall face of the recessed part, they can also have the same shape.

Further, in a manner similar to the ribbon supplying part 27, the ribbon take-up part 28 has a take-up part main body 28A connected to the connecting parts 29, 30, and a lid member 28B connected to the take-up part main body 28A along mating plane via a hinge part 28C (so-called P.P. hinge) openably and closably. While retained parts 36, 36 are provided on both of the right and left end faces of the take-up part main body 28A, retaining parts 37, 37 which are detachably engaged with the retained parts 36 and retain the lid member 28B by the take-up part main body 28A are provided on both of the right and left end faces of the lid member 28B.

While the retained parts 36 are protrusions projecting sideward, the retaining parts 37 are provided on the end faces of the lid member 28B via hinge members 38, 38 and have engagement holes 37A, 37A with which the protrusions are detachably engaged with. The ribbon take-up part 28 has: an engagement recessed part 41A as an engaged part provided near the retained part 36; a projection part 41B formed on a side of the take-up part main body 28A; and an engagement projecting part 42 that is provided near the retaining part 37, detachably engaged with the engagement recessed part 41A, and constructs the engagement relation countering the force acting in the direction of canceling the retaining relation of the retained part 36 and the retaining part 37. In this example, since the engaged part is the engagement recessed part 41A and the strong engagement relation is constructed with the engagement projecting part 42, the engagement relation between the engaged part and the engagement projecting part is formed only on one side face of the ribbon take-up part 28. However, similar engagement structures can be also provided on both of the right and left sides. In this case, in a manner similar to the ribbon supplying part 27, engagement structures which are different with respect to the right and left can be also constructed.

The connecting parts 29, 30 are provided with rectangular holding parts 43, 43 projectingly. The holding parts 43 are positioned near the ribbon take-up part 28 located on the side far from the hinge member 23. Although the holding part 43 has a rectangular shape, the shape is not limited to it. It is needless to say that various shapes can be used in consideration of function, layout, and the like.

Further, in the ribbon supplying part 27, bearings 27D, 27D for rotatably supporting a supply roll 44 for supplying the ink ribbon 26A are formed on the right and left side faces. In the ribbon take-up part 28, bearings 28D, 28D for rotatably supporting a take-up roll 45 for taking up the ink ribbon 26A are formed on the right and left side faces. The take-up roll 45 is rotated in the take-up direction by a motor (not shown) via a gear mechanism. The ink ribbon 26A is line-fed synchronously with the recording paper 5. By feeding the ink ribbon 26A and the recording paper 5 and pressure contacting of the ink ribbon 26A with the recording paper 5 by the print head 3, an image is recorded on the recording paper 5.

Figure 10A:
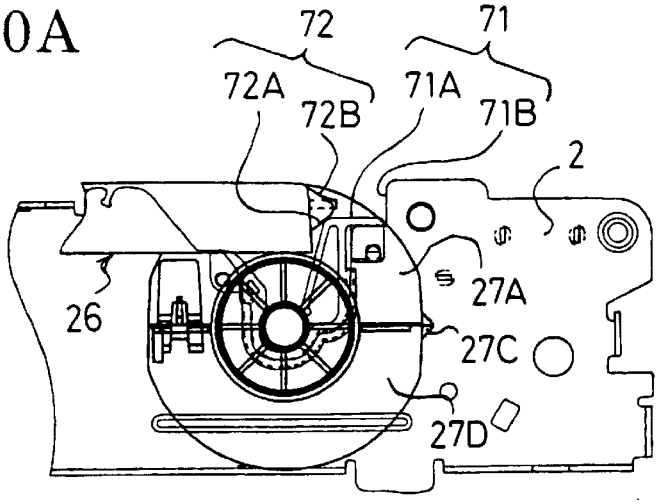
FIGS. 10A–10C are diagrams of the loading procedure.

Further, as shown in FIG. 10A, while an engaged part 71 having first and second engaged faces 71A, 71B is provided near the roll bearing part of the supply roll 44 in the ribbon supplying part 27 in the main body casing 2, a mountain-shaped engagement part 72 is provided near the ribbon supplying part 27 locating on the side near the hinge member 23. The engagement part 72 has a first engagement face 72A which comes into contact with the first engaged face 71A, of the engaged part 71 to form the rotation center for ejecting the cassette when the ribbon cassette 26 is ejected. In addition to the first engagement face 72A, the engagement part 72 also has a second engagement face 72B which comes into contact with the second engaged face 71B of the engaged part 71 subsequent to the first engagement face 72A to form another rotation center for ejecting the cassette. The first engaged face 71A of the engaged part 71 extends almost in the horizontal direction, and the second engaged face 71B extends almost in the vertical direction continuously from the first engaged face 71B.

As shown in FIG. 1, in the front upper part of the facsimile apparatus 1, an original feeding device 52 for feeding an original 71 at a constant speed and an original reading device 53 for reading an image recorded on the original fed by the original feeding device 52 are arranged. A panel cover 54 positioning on the surface has an operation panel (not shown) for performing various operations regarding facsimile transmission and the like. The operation panel includes a liquid crystal display, a keyboard, and the like.

The original feeding device 52 has: a feeding roller 55 for receiving the original 51; a separating member 56 for separating the originals 51 which come into contact with the feeding roller 55 and are fed one by one; an automatic document feed (ADF) plate spring 57 for energizing the separating member 56 in the direction so as to come into contact with the feeding roller 55; and a paper ejecting roller 59 for feeding the original 51 out with a roller 58. On the other hand, the original feeding device 53 has: a small read sensor 61 (CIS) held in the main body casing 2 via a holder 60; and a white platen roller 62 provided opposite to the read sensor 61.

When the originals 51 to be transmitted are put on an original receiving part 63 which is covered, it is detected by a sensor for detecting an original (not shown) and the originals 51 are reliably separated one by one by the separating member 56 and the feeding roller 55 and the original 51 is fed to the original reading position where the read sensor 61 is arranged. The sensor for detecting original is constructed by two sensors for detecting the presence and absence of the original 51 and also detecting whether the size of the original 51 is B4, A4, or letter size.

The image recorded on the original 51 is optically read by the read sensor 61 in the original reading position. The read original 51 is fed by the roller 58 and the paper ejecting roller 59 and finally ejected in front of the facsimile apparatus 1.

Figure 9A:
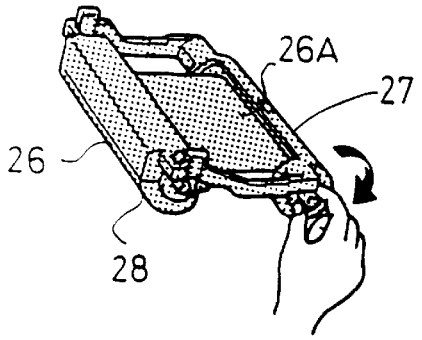
FIGS. 9A–9D are diagrams explaining a procedure for loading a ribbon cassette according to the invention.
Figure 9B:
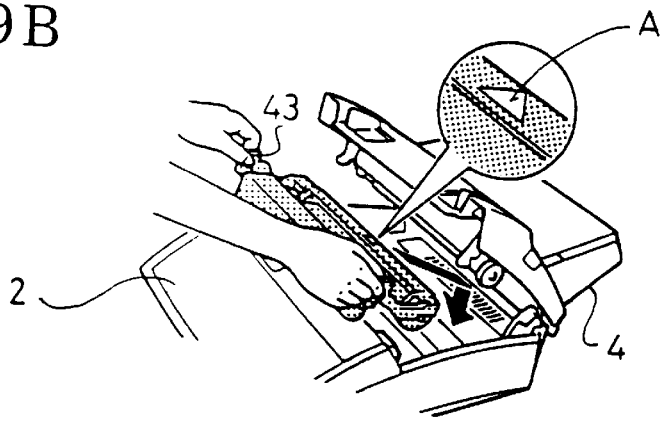
Figure 9C:
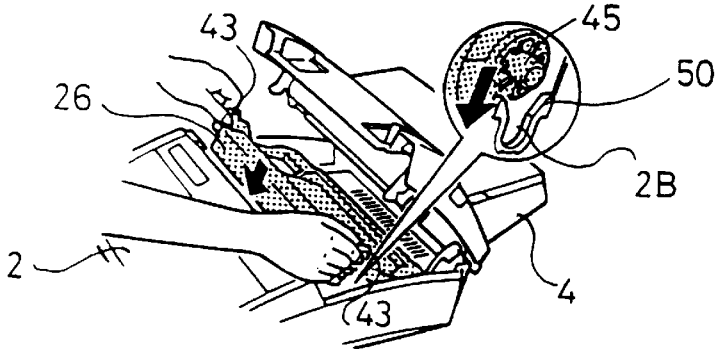
Figure 9D:
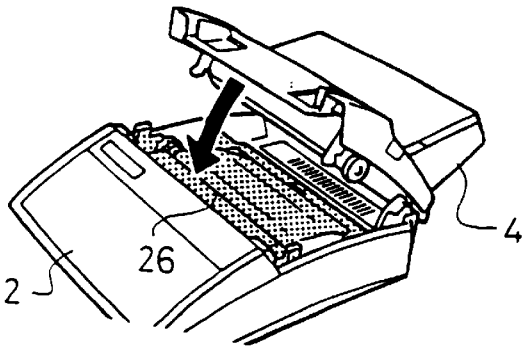

In the facsimile apparatus, therefore, when the ribbon cassette 26 is inserted into the opening 2A of the main body casing 2, as shown in FIG. 9A, the take-up roll 45 is rotated first and the ink ribbon is in a tensed state, the holding parts 43, 43 are held and the ribbon cassette 26 is inserted into the main body casing 2 by using the arrow A as a guide as shown in FIG. 9B. Then, as shown in FIG. 9C, while holding the holding parts 43, the ribbon cassette 26 is downwardly displaced and is set in a predetermined position, that is, a position where the shaft of the supply roll 44 is engaged with the roll bearing, 2B and after that, the lid member 4 is closed as shown in FIG. 9D.

On the other hand, when the ribbon cassette 26 is taken out, the holding parts 43 of the ribbon cassette 26 are held by both hands and lifted upward. By the lifting, when the ribbon cassette 26 is detached by holding the holding parts 43, the rotation center is changed by the engagement relation between the engagement part 72 on the ribbon cassette 26 side and the engaged part 71 on the bearing member 50 side of the main body casing 2. Thus, even when the opening angle of the lid member 4 with respect to the opening 2A of the main body casing 2 is small, the ribbon cassette can be detached easily.

Figure 10B:
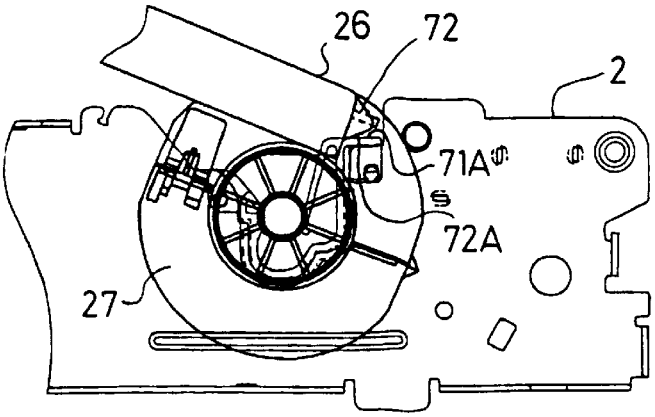
Figure 10C:
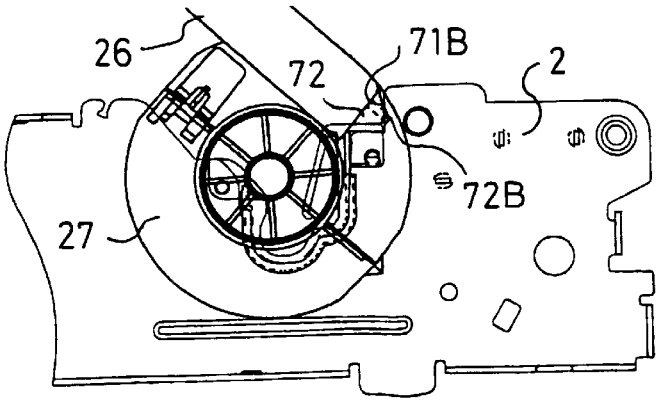
Figure 11:
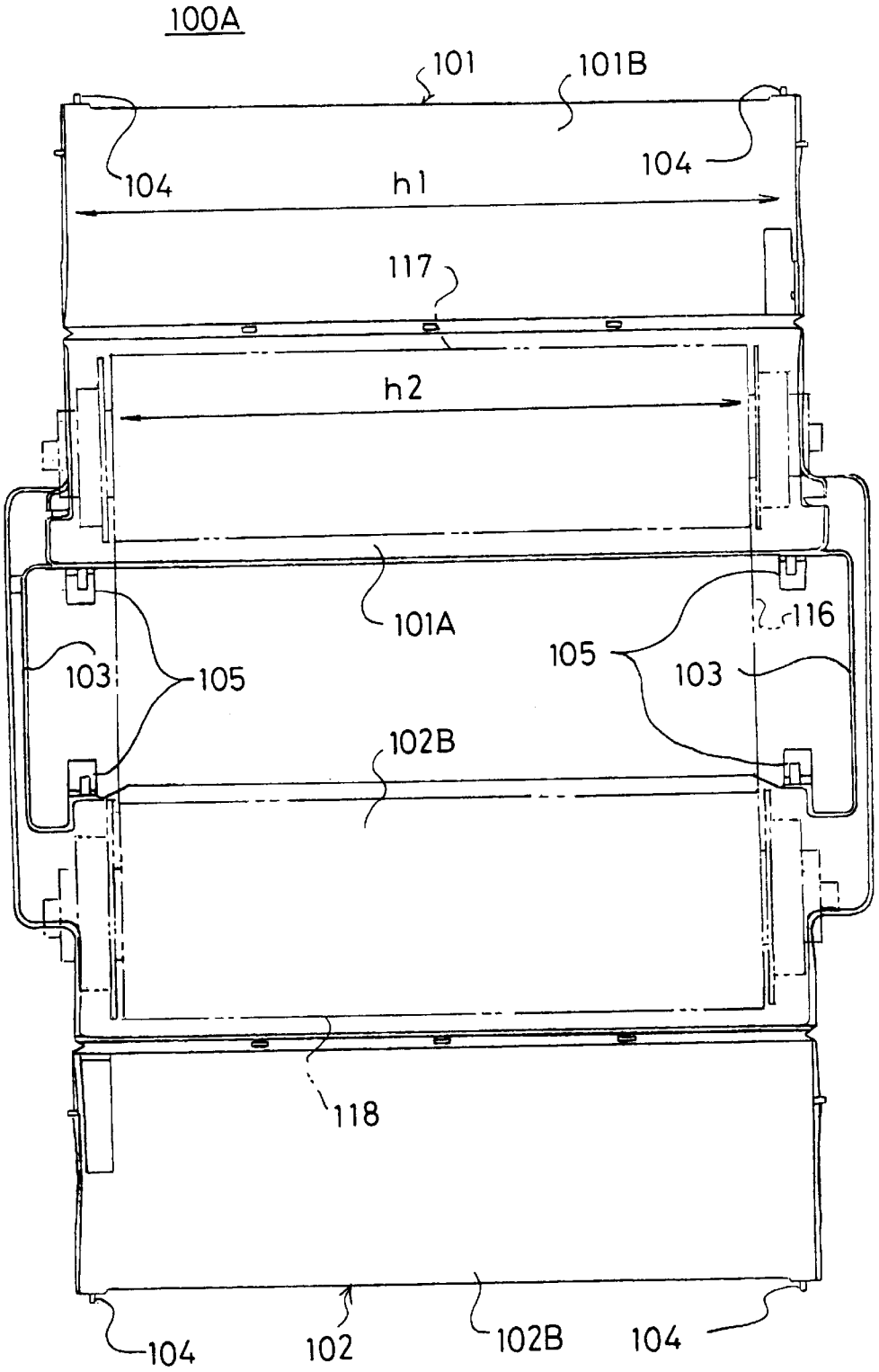
Fig.11 PRIOR ART
FIG. 11 is a plan view of a related art ribbon cassette in a state where a lid member is open.
Figure 12:
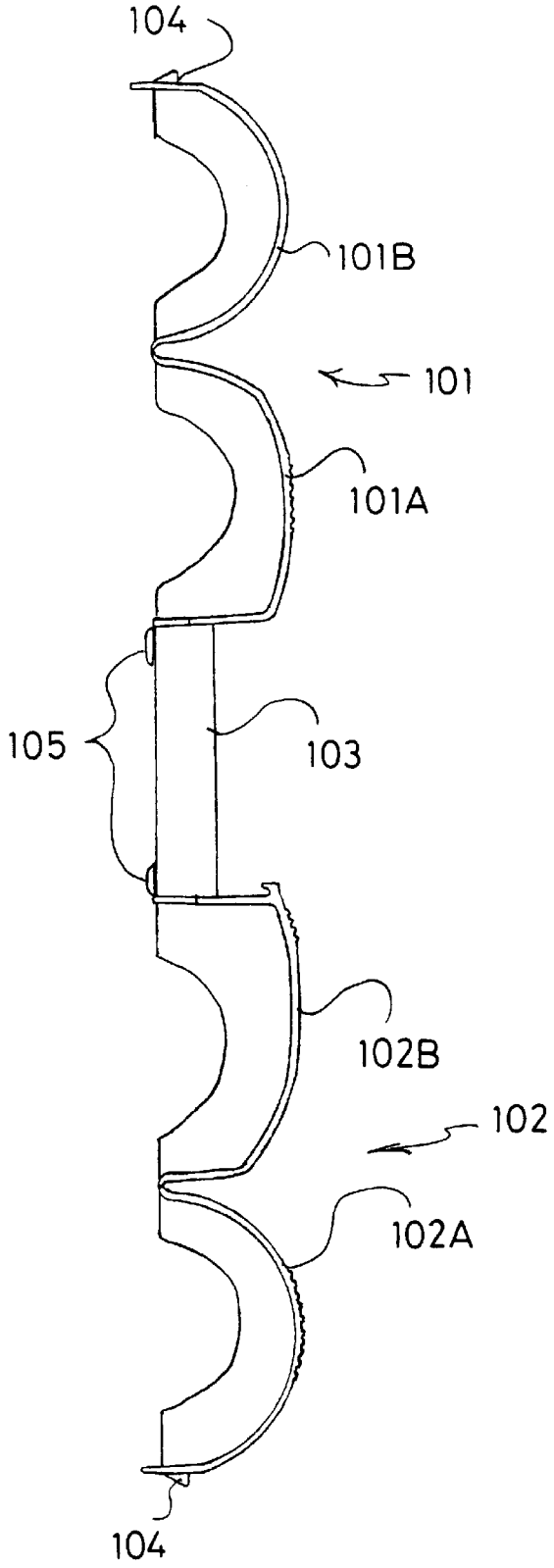
Fig.12 PRIOR ART
FIG. 12 is central longitudinal section of the related art ribbon cassette.
Figure 13A:
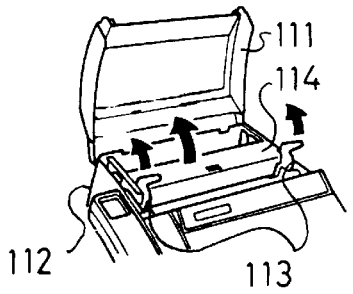
Fig.13A PRIOR ART
FIGS. 13A–13E are diagrams explaining a procedure for loading a related art ribbon cassette.
Figure 13B:
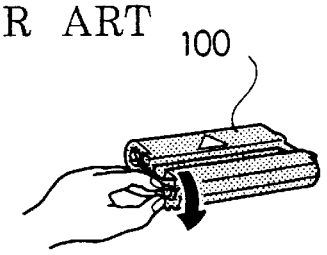
Fig.13B PRIOR ART
Figure 13C:
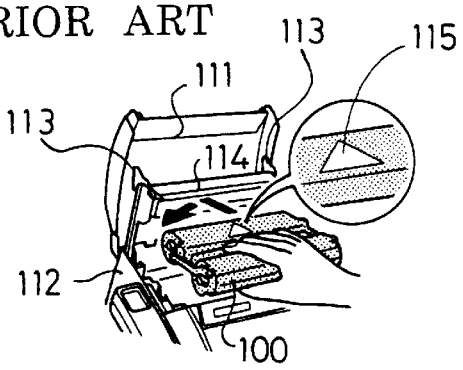
Fig.13C PRIOR ART
Figure 13D:
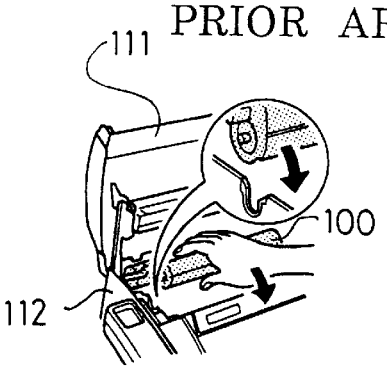
Fig.13D PRIOR ART
Figure 13E:
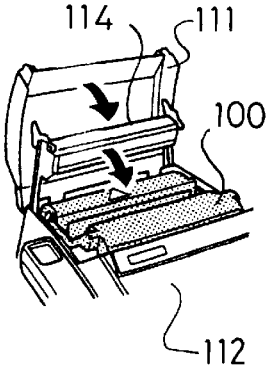
Fig.13E PRIOR ART

That is, when the holding parts 43 of the ribbon cassette 26 are held and the ribbon take-up part 28 side is lifted upward, as it is changed from the state shown in FIG. 10A to FIG. 10B, the engagement part 72 is climbed on the first engaged face 71A of the engaged part 71, and the rotation center of the ribbon cassette 26 is changed from the roll axis of the supply roll 44 to the part in which the first engagement face 72A of the engagement part 72 and the first engagement face 71A of the engaged part 71 are in contact. Even if the opening angle of the lid member 4 is small, the ribbon cassette 26 is largely risen and is easily ejected. Further, when the ribbon take-up part 28 side is lifted, as shown in FIG. 10C, the second engagement face 72B of the engagement part 72 comes into contact with the second engaged face 71B of the engaged part 71, and the rotation center of the ribbon cassette 26 is changed to the contacting part of them. The ribbon cassette 26 is largely risen and is ejected more easily.

By constructing as mentioned above, the retaining parts 32 provided on both end faces of the lid member 27B are detachably engaged with the retained parts 31 provided on both end faces of the supplying part main body 27A, thereby retaining the lid member 27B by the supplying part main body 27A. Therefore, the length in the axial direction of the ribbon supplying part 27 can be almost equalized to the width of the ink ribbon 26A, so that it is advantageous to realize the reduction in size.

Moreover, the protrusion is used as the retained part 31 and is detachably engaged with the engagement hole 32A of the retaining part 32, thereby retaining the lid member 27B by the supplying part main body 27A. Therefore, the lid member 27B can be securely retained by the supplying part main body 27A with a simple structure.

In addition, by attaching or detaching the ribbon cassette 26 by holding the holding parts 43 with both hands, an unnatural force (torsion force or the like) is not acted on the ribbon cassette 26, so that the retaining relation between the retained part 31 and the retaining part 32 is not cancelled during the attaching or detaching operation. Further, in the ribbon cassette, the force acting in the direction of cancelling the retaining relation between the retained parts 31 and the retaining parts 32 is positively countered by the engagement relation between the engaged parts 34A, 34B and the engagement projecting parts 35. Therefore, even if an unnatural force such as torsion force acts by chance when the ribbon cassette 26 is attached or detached to/from the main body casing 2, the retaining relation between the retained parts 31 and the retaining parts 32 is not cancelled, thereby preventing the lid member 27B from being abruptly opened.

Further, not only the ribbon supplying part 27 but also the ribbon take-up part 28 similarly has the retained parts 36, 41B the retaining parts 37, the engagement recessed part 41A, the engagement projecting part 41B, and the engagement projecting part 42. Therefore, not only in the ribbon supplying part 27 but also in the ribbon take-up part 28, the length in the axial direction of the ribbon take-up part 28 can be almost equalized to the width of the ink ribbon 26, so that it is advantageous to reduce the whole size. It is not cancelled by the unnatural force such as torsion force acting when the ribbon cassette 26 is attached or the like, so that the lid member 28B is prevented from being abruptly opened.

Although the example of applying the invention to the facsimile apparatus has been described in the foregoing embodiment, the invention is not limited to the above. The invention can be also similarly applied to even a printing apparatus having no original reading function if the printing apparatus has a recording medium housing part and a recording medium conveying part for ejecting a recording medium from the recording medium housing part and conveying it via a printing part to an ejecting part for ejecting the printed recording medium.

In the foregoing embodiment, in the ribbon supplying part and the ribbon take-up part of the ribbon cassette, the retained parts are provided on the end faces of the supplying part main body and the take-up part main body, and the retaining parts which are detachably engaged with the retained parts to retain the lid member by the supplying part main body are provided on the end faces of the lid member. However, the invention is not limited to the above. On the contrary, the retained parts can be provided on the end faces of the lid member and the retaining parts can be provided on the end faces of the supplying part main body and the take-up part main body. In addition, the shape of the retained part and the retaining part is not limited to the shape shown as an example in the embodiment. It is obviously understood that various shapes can be used, and further, different shapes with respect to the right and left side faces can be also used.

What is claimed is:

1. A ribbon cassette compromising a ribbon supplying part for supplying an ink ribbon, a ribbon take-up part for taking up the ribbon and a connecting part for connecting the supplying and take-up parts, comprising:

a supplying part main body formed as part of the ribbon supplying part, said supplying part main body being connected to the connecting part, and the ribbon supplying part including a lid member openably and closably connected to the supplying part main body:

a retained part provided on an end face of one of the supplying part main body and the lid member;

a retaining part detachably engaged with the retained part to retain the lid member by the supplying part main body, said retaining part being provided on an end face of the other one of the supplying part main body and the lid member;

an engaged part provided adjacent one of the retained part and the retaining part; and an engagement projecting part detachably engaged with the engaged part and spaced away from the other one of the retained part and the retaining part by a gap in which the engaged part is disposed, thereby constructing an engagement relation countering a force acting to cancel the retaining relation between the retained part and the retaining part.

2. A ribbon cassette according to claim 1, wherein the retained part comprises a protrusion projecting sideward, and the retaining part is provided on the end face of the other one of the supplying part main body and the lid member via a hinge part and has an engagement hole with which the protrusion is detachably engaged.

3. A ribbon cassette comprising a ribbon supplying part for supplying an ink ribbon, a ribbon take-up part for taking up the ink ribbon, and a connecting part for connecting the ribbon supplying and take-up parts, comprising:

a take-up part main body connected to the connecting part;

a first lid member openably and closably connected to the take-up part;

a first retained part provided on an end face of one of the take-up part main body and the first lid member;

a first retaining part detachably engaged with the first retained part to retain the first lid member by the take-up part provided on an end face of the other one of the take-up main body and the first lid member;

a first engaged part provided adjacent one of the first retained part and the first retaining part;

a first engagement projecting part detachably engaged with the first engaged part and provided adjacent the other one of the first retained part and the first retaining part, thereby constructing a first engagement relation countering a first force to cancel the retaining relation between the first retained part and the first retaining part, wherein the ribbon supplying part has a supplying part main body connected to the connecting part and a second lid member that is openably and closably connected to the supplying part main body, the ribbon supplying part comprising:

a second retained part provided on an end face of one of the supplying part main body and the second lid member;

a second retaining part detachably engaged with the second retained part to retain the second lid member by the supplying part main body provided on the end face of the other one of the supplying part main body and the second lid member;

a second engaged part provided adjacent one of the second retained part and the second retaining part; and a second engagement projecting part detachably engaged with the second engaged part and spaced away from the other one of the second retained part and the second retaining part by a gap in which the engaged part is disposed, thereby constructing a second engagement relation countering a second force to cancel the retaining relation between the second retained part and the second retaining part.

4. A ribbon cassette according to claim 3, wherein the second retained part comprises a second protrusion projecting sideward, and the second retaining part is provided on the end face of the other one of the supplying part main body and the second lid member via a second hinge part and has a second engagement hole with which the second protrusion is detachably engaged.

5. A ribbon cassette according to claim 3, wherein the first retained part comprises a first protrusion projecting sideward, and the first retaining part is provided on the end face of the other one of the take-up part main body and the first lid member via a first hinge part and has a first engagement hole with which the first protrusion is detachably engaged.

6. A printing apparatus comprising:

a main body casing having an opening for receiving a recording head and a lid member for openably and closably closing the opening of the main body casing; and a ribbon cassette comprising a ribbon supplying part for supplying an ink ribbon, a ribbon take-up part for taking up the ink ribbon, and a connecting part for connecting the supplying and take-up parts, comprising:

a supplying part main body formed as part of the ribbon supplying part, said supplying part main body being connected to the connecting part, and the ribbon supplying part including a lid member openably and closably connected to the supplying part main body;

a retained part provided on an end face of one of the supplying part main body and the lid member;

a retaining part detachably engaged with the retained part to retain the lid member by the supplying part main body, said retaining part being provided on an end face of the other one of the supplying part main body and the lid member;

an engaged part provided adjacent one of the retained part and the retaining part; and an engagement projecting Part detachably engaged with the engaged part and spaced away from the other one of the retained part and the retaining part by a gap in which the engaged part is disposed, thereby constructing an engagement relation countering a force acting to cancel the retaining relation between the retained part and the retaining part;

wherein the ribbon cassette is detachably attached in the main body casing from the opening in correspondence to the recording head.

7. A facsimile apparatus comprising:

a reception buffer for storing received reception image information; and a recording means that has a recording head including a plurality of heater elements arranged in a line for recording the reception image information onto a recording medium via an ink ribbon having a width that substantially matches a recording area width of the recording head, wherein the recording means comprises:

a printing apparatus including a main body casing having an opening for receiving the recording head and a lid member for openably and closably closing the opening of the main body casing, and a ribbon cassette comprising a ribbon supplying part for supplying the ink ribbon, a ribbon take-up part for taking up the ink ribbon, and a connecting part for connecting the supplying and take-up parts, comprising:

a supplying part main body formed as part of the ribbon supplying part, said supplying part main body being connected to the connecting part, and the ribbon supplying part including a lid member openably and closably connected to the supplying part main body, a retained part provided on an end face of one of the supplying part main body and the lid member, a retaining part detachably engaged with the retained part to retain the lid member by the supplying part main body, said retaining part being provided on an end face of the other one of the supplying part main body and the lid member, an engaged part provided adjacent one of the retained part and the retaining part; and an engagement projecting part detachably engaged with the engaged part and spaced away from the other one of the retained part and the retaining part by a gap in which the engaged part is disposed, thereby constructing an engagement relation countering a force acting to cancel the retaining relation between the retained part and the retaining part, wherein the ribbon cassette is detachably attached in the main body casing from the opening in correspondence to the recording head.

8. A ribbon cassette comprising a ribbon supplying part that supplies an ink ribbon, a ribbon take-up part that takes up the ink ribbon, and a connecting part that connects the ribbon supplying part and the ribbon take-up part, comprising:

a take-up part main body connected to the connecting part, the take-up main body including a surface defining a mating plane;

a lid member openably and closably connected to the take-up part main body along the mating plane;

an engagement recessed part provided on an end face of the take-up part main body;

an engagement projection part provided on the lid member that protrudes through said mating plane and into said engagement recessed part;

a retained part provided on the end face of the take-up part main body;

a retaining part provided adjacent said engagement projection part and on an end face of the said lid member, said retaining part being detachably engageable with said retained part; and a projecting part provided adjacent said engagement recessed part, said projecting part being fixed on the end face adjacent said retained part and extending through said mating plane.

9. A ribbon cassette comprising a ribbon supplying part that supplies an ink ribbon, a ribbon take-up part that takes up the ink ribbon, and a connecting part that connects the ribbon supplying part and the ribbon take-up part, comprising:

a supplying part main body connected to the connecting part, said supplying part main body including a surface defining a mating plane;

a lid member openably and closably connected to the supplying part main body along said mating plane;

an engagement projecting part disposed to overlap with said ink ribbon in a plane perpendicular to the mating plane, said engagement projecting part being provided on said lid member and extending through said mating plane when the supplying part main body and the lid member mate, said engagement projecting part being spaced inwardly from an end face of the lid member to define a gap;

an engaged part provided on said supplying part main body, said engaged part being disposed within the gap and engageable with said engagement projecting part;

a retained part provided on an end face of said supplying part main body adjacent said engaged part; and a retaining part provided on said lid member and being disposed on an opposite side of said gap from said engagement projecting part, said retaining part being detachably engageable with said retained part.

10. A ribbon cassette comprising a ribbon supplying part that supplies an ink ribbon, a ribbon take-up part that takes up the ink ribbon, and a connecting part that connects the ribbon supplying part and the ribbon take-up part, the ribbon take-up part comprising:

a take-up part main body connected to the connecting part, the take-up main body including a surface defining a mating plane;

a lid member openably and closably connected to the take-up part main body along the mating plane;

an engagement recessed part provided on an end face of the take-up part main body;

an engagement projection part provided on the lid member that protrudes through said mating plane and into said engagement recessed part;

a retained part provided on the end face of the take-up part main body; and a retaining part provided adjacent said engagement projection part and on an end face of the said lid member, said retaining part being detachably engageable with said retained part, the ribbon supplying part comprising:

a supplying part main body connected to the connecting part, said supplying part main body including a surface defining a mating plane;

a lid member openably and closably connected to the supplying part main body along said mating plane;

an engagement projecting part disposed to overlap with said ink ribbon in a plane perpendicular to said mating plane, said engagement projecting part being provided on said lid member and extending through said mating plane when the supplying part main body and the lid member mate, said engagement projecting part being spaced inwardly away from an end face of the lid member to define a gap;

an engaged part provided on said supplying part main body, said engaged part being disposed within the gap and engageable with said engagement projecting part;

a retained part provided on an end face of said supplying part main body adjacent said engaged part; and a retaining part provided on said lid member and disposed on an opposite side of said gap from said engagement projecting part, said retaining part being detachably engageable with said retained part.

11. A ribbon cassette according to claim 10, wherein the ribbon take-up part further comprises a projecting part provided adjacent the engagement recessed part.

* * * * *